United States Patent [19]

Hanzel et al.

[11] 4,296,174

[45] Oct. 20, 1981

[54] SPANDEX FILAMENTS CONTAINING CERTAIN METALLIC SOAPS

[75] Inventors: Robert S. Hanzel, Wilmington, Del.; Paul J. Sauer, Waynesboro, Va.

[73] Assignee: E. I. Du Pont de Nemours and Company, Wilmington, Del.

[21] Appl. No.: 176,594

[22] Filed: Aug. 8, 1980

[51] Int. Cl.[3] ..... D01F 6/70; D06M 11/04; D06M 13/24; D02G 3/32

[52] U.S. Cl. ..... 428/389; 8/115.6; 252/8.6; 260/23 TN; 428/372; 428/394; 428/395; 528/906

[58] Field of Search ..... 528/906; 252/8.6; 8/115.6; 428/375, 394, 395, 389, 372; 260/22 CQ, 23 TN

[56] References Cited

U.S. PATENT DOCUMENTS

| | | | |
|---|---|---|---|
| 2,223,158 | 11/1940 | Licata | 134/11 |
| 2,278,207 | 3/1942 | Mathes | 428/378 |
| 2,929,804 | 3/1960 | Steuber | 528/61 |
| 3,039,895 | 6/1962 | Yuk | 252/8.6 |
| 3,097,192 | 7/1963 | Schilit | 528/61 |
| 3,296,063 | 1/1967 | Chandler | 260/29.1 SB |
| 3,428,711 | 2/1969 | Hunt | 525/127 |
| 3,553,290 | 1/1971 | Hunt | 525/455 |
| 3,555,115 | 1/1971 | Bottomley | 525/458 |
| 3,704,160 | 11/1972 | Steinmiller | 252/8.6 |
| 4,139,479 | 2/1979 | Goffinet | 252/8.8 |

FOREIGN PATENT DOCUMENTS

| | | |
|---|---|---|
| 1015035 | 12/1965 | United Kingdom . |

*Primary Examiner*—Dennis L. Albrecht

[57] ABSTRACT

Spandex filaments are provided with decreased tackiness by effective amounts of soap dispersed within the filaments. The soap is a metal salt of a fatty acid, the metal being calcium, lithium or magnesium and the fatty acid being a saturated or unsaturated fatty acid having 10 to 22 carbon atoms. Stearates are preferred.

6 Claims, 6 Drawing Figures

SPANDEX FILAMENTS CONTAINING CERTAIN METALLIC SOAPS

BACKGROUND OF THE INVENTION

1. Field of the Invention

This invention concerns a spandex filament of the type which has improved tack characteristics and more particularly, such a spandex filament having certain metallic soaps dispersed within it.

2. Description of the Prior Art

Spandex filaments are known to exhibit considerable tackiness, as compared to conventional textile filaments. The spandex filaments tend to stick to various surfaces and to cohere to each other, especially when wound up on a bobbin or other package. This tackiness can cause excessive unwinding tension (referred to hereinafter as "take-off tension") as well as frequent, large transients in take-off tension. As the age of wound-up spandex filaments increases, these effects of tackiness usually worsen. Excessive take-off tensions and transients cause fabric defects and other manufacturing difficulties, particularly in circular knit hosiery fabrics.

In the art, various substances are suggested for lubricating the surfaces of spandex filaments as a means of reducing the tackiness of the filaments. For example, Yuk, U.S. Pat. No. 3,039,895, discloses that certain finely divided metallic soaps dispersed in textile oils, make very useful finishes for this purpose. The soaps suggested by Yuk include certain metal salts of certain acids. The metal component of the soap is selected from lithium, sodium, potassium, rubidium cesium, magnesium, calcium, strontium, barium, zinc, cadmium and aluminum and the acid component is selected from saturated or unsaturated fatty acids having 8 to 22 carbon atoms. Magnesium stearate is particularly preferred. Yuk suggests that the metallic soap should amount to 2 to 20% by weight of the finish and that the finish, when applied to the surface of the spandex filaments, should amount to at least 3.5%, preferably more than 5%, by weight of the filaments.

Chandler, U.S. Pat. No. 3,296,063, discloses another finish that is useful in reducing spandex filament tackiness. The finish has as essential ingredients a minor proportion of polyamylsiloxane and a major proportion of polydimethylsiloxane. A preferred finish contains 10% polyamylsiloxane and 90% polydimethylsiloxane. For lubricating spandex yarns, Chandler suggests that the finish usually should amount to at least 1% by weight of the yarn and preferably from about 2% to about 4%. The finish can be applied to the filaments by conventional techniques, such as dipping, padding, and spraying or by addition of the finish to the spinning solution for extrusion simultaneously with the fiber-forming materials. Chandler states that in some instances, metallic soaps such as those disclosed by Yuk (e.g., zinc stearate and magnesium stearate) may be used in the finish in small amounts (i.e., less than about 2% by weight of the finish). However, Chandler then points out that use of his mixtures of polysiloxanes completely eliminates the need for such dispersed solids in the finish.

Among the best lubricating finishes that have been applied to the surfaces of commercial spandex filaments is one that contains finely divided magnesium stearate in a mixture of 10% polyamylsiloxane and 90% polydimethylsiloxane, with the magnesium stearate amounting to between 4 and 10% by total weight of the finish.

Such a finish can provide the spandex filaments with average take-off tensions of about 0.2 to 0.5 gram (measured as described hereinafter) but still cannot eliminate the numerous, large tension transients.

To further reduce the effects of the spandex filament tackiness, the general practice has been to store freshly spun, lubricated and wound-up filaments for three to four weeks and then to rewind them onto another package. This decreases the average take-off tension to about 0.1 gram and substantially diminishes the tension transients, usually to less than 0.4 gram. However, further aging of the rewound filaments (e.g., for two months or more) can necessitate another rewinding. Although such storage-and-rewinding operations reduce the take-off tension and transients to desirably low levels, such operations are costly and time consuming.

It is a purpose of this invention to provide as-spun spandex filaments which are relatively nontacky, which do not increase significantly in tackiness with age, which exhibit low average take-off tensions and only small tension transients, and which eliminate the previously needed storage-and-rewinding steps.

SUMMARY OF THE INVENTION

The present invention provides an improved spandex filament of the type that has a conventional lubricating finish on its surface. The improvement of the present invention comprises a soap dispersed within the filament, the soap being a metal salt of a fatty acid amounting to at least 0.3% by weight of the filament. The metal component of the soap is selected from the group consisting of calcium, magnesium and lithium and the fatty acid component of the soap is selected from the group consisting of saturated and unsaturated fatty acids having 10 to 22 carbon atoms. Usually, the soap concentration in the filament is no more than 5% and preferably in the range of 0.5 to 1.0%. The preferred soaps are metal stearates with calcium stearate particularly being preferred.

BRIEF DESCRIPTION OF THE DRAWINGS

The invention will be more readily understood by reference to the drawings.

DETAILED DESCRIPTION OF THE INVENTION

Figure 1:
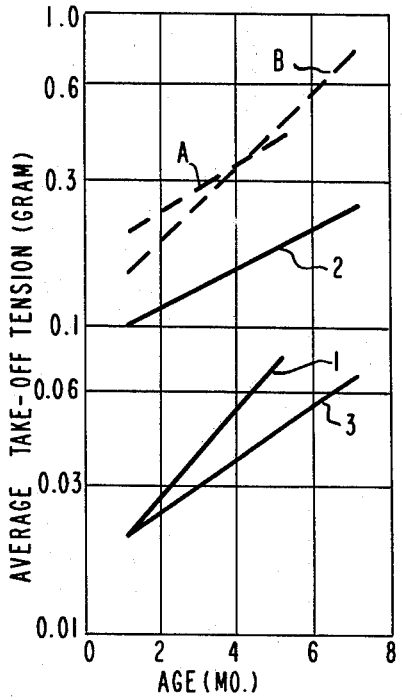
FIGS. 1 through 5 are semi-logarithmic plots of the average take-off tension versus the age of the spandex filaments of Examples I through V. The solid lines in these figures represent filaments containing metal soaps in accordance with the invention and the interrupted lines represent corresponding control filaments within which there are no metal soaps.

The filaments which are improved by having soaps dispersed within them in accordance with the invention are spandex filaments that have conventional lubricating finishes on their surfaces. Examples of such finishes are described in U.S. Pat. Nos. 3,039,895 and 3,296,063. The spandex filaments useful in the present invention are manufactured from fiber-forming, long chain, synthetic polymer comprised of at least 85% of a segmented polyurethane. The preferred spandex filaments for use in the present invention are made from linear, segmented polyurethane polymers, such as those based on polyethers or polyesters. Such filaments are prepared by well known methods, such as those described in U.S. Pat. Nos. 2,929,804, 3,097,192, 3,428,711, 3,553,290 and 3,555,115.

The soaps that are useful in the spandex filaments of the present invention are metal salts of fatty acids. The fatty acid component of the soap is a saturated or unsaturated fatty acid having 10 to 22 carbon atoms. The metal component of the soap is calcium, lithium or magnesium. These soaps, when dispersed within the spandex filaments in accordance with the invention are capable of reducing the tension transients to insignificant levels and the average take-off tensions to below 0.1 gram, even to as low as 0.02 gram. In contrast, soaps such as sodium stearate, potassium stearate, aluminum stearate, zinc stearate barium stearate, and others do not provide such advantageous reductions in tackiness and filaments containing these soaps must be rewound to approach the low take-off tensions and paucity of transients achieved by use of soaps in accordance with the invention. It was surprising that only the calcium, lithium or magnesium salts showed such an unusually strong ability to reduce the tackiness of spandex filaments.

The soap concentration that is effective in reducing the tackiness of the spandex filament to a desirably low level amounts to at least 0.3% by weight of the filament. Larger reductions in tackiness are obtained as the soap concentration within the filament is increased above this level. However, a concentration of no more than 5% is usually used to avoid adverse effects on some of the other physical properties of the filament which might result from excessive amounts of the soap being present in the spandex filament. The concentration range which generally gives the best results is from about ½ to about 1%.

The metallic soap additive, in accordance with the present invention, is made by conventional techniques and is used in finely divided form. Small particles, usually of less than 40-micron maximum size, are used. Particles of greater than 40-micron maximum size can sometimes lead to difficulties in filament spinning. The metallic soap can be added separately to the polymer spinning solution, as a powder or as a slurry in a suitable medium.

In addition to the particular metal soaps, spandex filaments of the invention may also contain additives for other purposes, such as delusterants, antioxidants, pigments, stabilizers against heat, light and fumes, and the like, so long as such additives do not produce antagonistic effects with the metal soaps.

Figure 3:
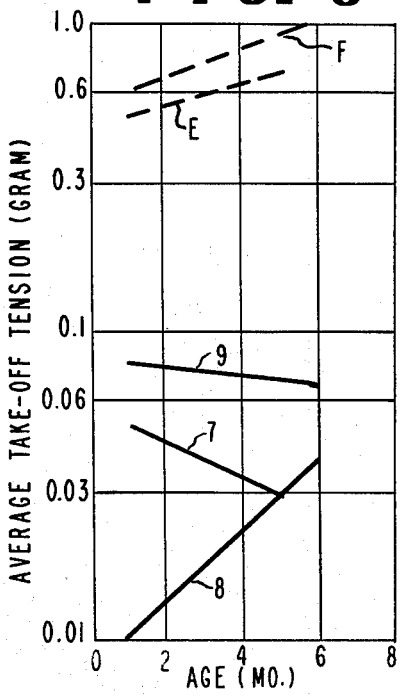

The reduction in tackiness provided by the present invention depends on several factors in addition to the concentration of the particular metal soap additive. The reduction depends on tackiness of the spandex polymer per se, the particular additives contained in the filament and the specific finish applied to the filament surface. In the Examples below some of the effects of these factors can be seen. For example, the polyether-based spandex filaments of Examples III and IV (FIGS. 3 and 4) are much tackier than the polyester-based spandex filaments of Example V (FIG. 5). Also, whereas calcium stearate is the preferred soap for reducing the tackiness of the spandex filaments of Examples III, IV and V, lithium stearate and magnesium stearate are more effective in the spandex filaments of Examples I and II. Other factors also affect the selection of the particular soap of the invention that is to be used for a particular spandex filament. For example, although magnesium stearate can be an effective additive for reducing spandex filament tackiness, in some spandex polymers it has a deleterious effect on the ability of the polymer to resist discoloration due to heat, light or fumes. Calcium stearate in contrast has little deleterious effect on the resistance to discoloration. Furthermore, it has been found that soaps made from fatty acids that have very low levels of unsaturation favor improved discoloration resistance. Accordingly, soaps made from fully saturated fatty acids are preferred for use in this invention. In view of these factors, care must be exercised in the selection of the particular soap of the invention to be used in any specific spandex yarn and it is recommended that some simple tests, similar to those described in the Examples, be run beforehand to assure the compatibility of the metal soap of the invention and the particular spandex polymer, additives and finishes under consideration.

The following test procedures are used for measuring various parameters discussed above.

Figure 6:
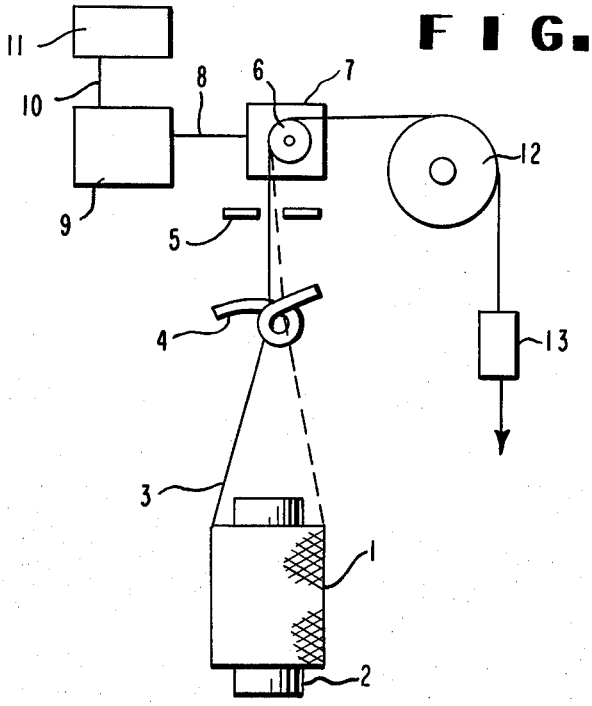
FIG. 6 is a schematic diagram of an apparatus for measuring take-off tension.

As defined herein, take-off tension is the tension required for delivery of 50 yards (45.7 meters) per minute of spandex yarn over the end of a yarn package. This tension is measured in accordance with the following procedure and by means of the apparatus depicted in FIG. 6. A spandex yarn 3 (numerals refer to FIG. 6), wound into a package 1 on a tube measuring of about 3.1 inches (7.9 cm.) in diameter and 4.6 inches (11.6 cm.) in length is stripped from the package until a 0.12-inch (3-mm) thickness of yarn remains on tube 2. The yarn 3 is then strung-up in succession over the end of package 1, through pigtail 4, through ceramic slot guide 5, over tensiometer roller 6 where it makes a 90° turn, at least one-and-a-quarter wraps around puller roll 12 which is driven by a motor (not shown) and finally through sucker gun 13 to a collection bin (not shown). Free-wheeling tensiometer roller 6 is attached to calibrated strain gauge 7 which is connected via electrical lines 8 and 10 to recorder 9 and electronic counter and integrator 11. Take-up roll 12 is driven to remove yarn 3 from package 1 at 50 yards (45.7 meters) per minute. The average tension required to remove the yarn at this rate and the number of tension transients of a predetermined size (which is preset in the electronic counter) are measured and recorded. The test is run for four minutes, so that for each measurement 200 yards (183 meters) are examined.

A convenient means for determining the concentration of metal soap dispersed in the spandex filament involves analyzing for the metal component of the soap. For example, the amount of calcium stearate one has added to a spandex filament can be determined as follows. A weighed sample of spandex filament is placed in a platinum dish and ashed in a muffle furnace at 800° C. for 10 minutes. The thusly formed residue is dissolved in hydrochloric acid solution. Insoluble matter is removed by filtration. For calcium analyses, the filtrate is treated with a lanthanum chloride solution to remove interfering ions. Then, in accordance with procedures described, for example, in "Analytical Methods for Atomic Absorptions", Perkin-Elmer Corp. of Norwalk, Connecticut (1973), the treated filtrate is analyzed with an atomic absorption spectrophometer equipped with an appropriate lamp and calibrated with a sample containing a known amount of calcium. The concentration can then be expressed as a percentage of the total weight of the fiber. Similar analytical procedures can be used for determining the concentration of lithium soaps or magnesium soaps.

The invention is further illustrated, but is not intended to be limited, by the following examples, in which all percentages are by total weight of the fiber, unless specified otherwise. In each example, a linear segmented polyurethane spandex yarn is produced. In Examples I through IV and VI, the spandex is polyether-based; in Example V, polyester-based. Control yarns, which have no metallic soap dispersed within the filaments, are designated by capital letters. Test yarns in which metallic soaps are dispersed in accordance with the invention are designated by arabic numerals. Immediately after being dry spun and before being wound on a package, a conventional lubricating finish is applied to each yarn by a finish roll. The finish amounts to between 5½ and 7% by weight of the yarn and consists essentially of 91.2% of polydimethylsiloxane of 10-centistoke viscosity, 4.8% of polyamylsiloxane of 10,000- to 15,000-centistoke viscosity and 4.0% magnesium stearate. For each yarn made, one pound (0.45 kg) of yarn was wound on a package.

Examples I through V demonstrate the surprisingly large reductions in average take-off tension and tension transients that are obtained when effective amounts of magnesium stearate, calcium stearate or lithium stearate are dispersed within the filaments of the spandex yarn. Example VI illustrates the large reduction in tackiness that is obtained when metal soaps formed from magnesium, or calcium or lithium and fatty acids having 10 to 22 carbon atoms are used in spandex filament yarns.

EXAMPLE I

A solution of segmented polyurethane in N,N-dimethylacetamide was prepared in accordance with the general procedure described in U.S. Pat. No. 3,428,711 (e.g., first sentence of Example II and the description of Example I). An intimate mixture was prepared of p,p'-methylenediphenyl diisocyanate and polytetramethylene ether glycol (of about 1800 molecular weight) in a molar ratio of 1.70 and was held at 80° to 90° C. for 90 to 100 minutes to yield an isocyanate-terminated polyether (i.e., a capped glycol), which was then cooled to 60° C. and mixed with N,N-dimethylacetamide to provide a mixture containing about 45% solids. Then, while maintaining vigorous mixing, the capped glycol was reacted for 2 to 3 minutes at a temperature of about 75° C. with diethylamine (a chain terminator) and an 80/20 molar ratio of ethylenediamine and 1,3-cyclohexylenediamine chain extenders. The molar ratio of diamine chain extender to diethylamine was 6.31 and the molar ratio of diamine chain extenders to unreacted isocyanate in the capped glycol was 0.948. The resultant solution of segmented polyurethane contained approximately 36% solids and had a viscosity of about 2100 poises at 40° C. This polymer had an intrinsic viscosity of 0.95, measured at 25° C. in N,N-dimethylacetamide at a concentration of 0.5 gram per 100 ml of solution.

To the resultant viscous polymer solution were added titanium dioxide, a copolymer of diisopropylaminoethyl methacrylate and n-decyl methacrylate (in a 70/30 weight ratio), 1,1-bis (3-t-butyl-6-methyl-4-hydroxyphenyl)butane, and ultramarine blue pigment (sold by Reckitts, Ltd., North Humberside, England) in addition to the amounts of the particular metal stearates indicated in Table I below, such that these additives respectively amounted to 4.7, 4.7, 1.0, and 0.01% based on the weight of the final fibers.

The above-described spin mixture was then dry spun through orifices in a conventional manner to form coalesced 10-filament, 140-denier yarns. The surface lubricating finish mentioned above (i.e., 91% polydimethylsiloxane, 5% polyamylsiloxane and 4% magnesium stearate) was applied to the yarn and the yarn was wound on a package.

Yarn "1" and control "A" were made in one series of runs with the above-described procedure while yarns "2" and "3" and control "B" were produced in a second series of runs. The yarns were tested for tackiness by the take-off tension test after about a month and after about a half year of storage. The results of the tests are tabulated in Table I and depicted in FIG. 1.

The results of these tests show the great reduction in average take-off tension and tension transients provided by the test yarns of the invention in comparison to the control yarns of the art. Note that controls "A" and "B" had average take-off tensions that were much larger than those of yarns "1", "2" and "3" of the invention. Furthermore, the controls exhibited numerous undesirable large tension transients, whereas the yarns of the invention, which contained effective amounts of magnesium stearate, lithium stearate, or calcium stearate, exhibited almost no transients of greater than 1 gram even after a half year of storage.

EXAMPLE II

Figure 2:
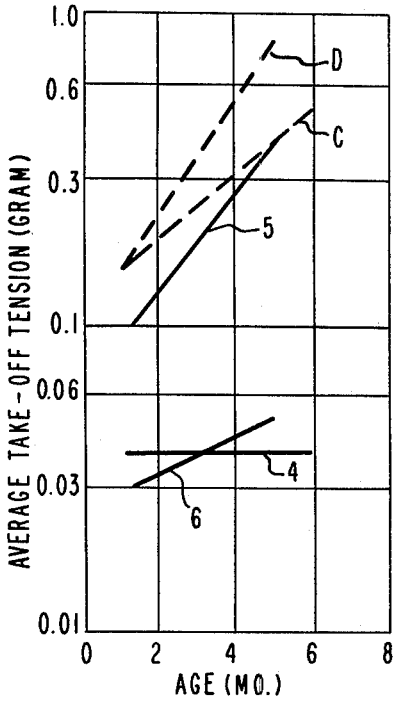

Example I was repeated except that no titanium dioxide was included in the polymer solution spin mixture. Yarn "4" of the invention and control "C" were made in one series of runs with this spin mixture while yarns "5" and "6" and control "D" were made in a second series of runs with a substantially identically prepared mixture. These yarns were then stored and tested for tackiness as in Example I. The results are summarized in Table I and depicted in FIG. 2. As in Example I, the yarns of the invention exhibited very much less tackiness than the controls.

EXAMPLE III

The procedure for making the spandex yarn of Example I was substantially repeated except that (1) only ethylene diamine was used as the chain extender (2) a small amount of another conventional chain terminator was used (3) the methacrylate copolymer and the 1,1-bis(3-t-butyl-6-methyl-4-hydroxyphenyl)butane that were added to the viscous polymer solution were replaced by (a) 3% of the polyurethane formed from t-butyldiethanolamine and methylene-bis-(4-cyclohexylisocyanate) as described in U.S. Pat. No. 3,555,115 and (b) 1.2% of the condensation polymer formed from p-cresol and divinyl benzene, as described in U.S. Pat. No. 3,553,290, and (4) 8-filament yarns were spun. Yarn "7" of the invention and control "E" were prepared in one series or runs with this spin mixture while yarns "8" and "9" and control "F" were prepared in a second series of runs with a substantially identically prepared mixture. These yarns were then lubricated with the surface finish, wound up, stored and tested for tackiness. The results are summarized in Table II and depicted in FIG. 3. As in the preceding examples, the results demonstrate that spandex yarns containing effective amounts of magnesium stearate, calcium stearate or lithium stearate reduce the tackiness of such spandex yarns by surprisingly large factors and that a large reduction in tackiness persists even after many months of storage.

EXAMPLE IV

A polymer solution was prepared substantially as described in Example I, except that a small amount of additional chain terminator was added in the chain extension step. To this polymer solution, the same additives as were used in Example III were added except that the amount of the polyurethane additive was 1% and of the condensation polymer was 1.2%. The spin mixture was then dry spun to form coalesced 10-filament, 140-denier yarns, which were then lubricated with surface finish, wound-up, stored and tested, as in the preceding examples. Yarn "10" of the invention and control "G" were made in one series of spins of 12-filament yarns while yarns "11" "12" and "13" and controls "H" and "I" were prepared in a second series of spins of 10-filament yarns.

Figure 4:
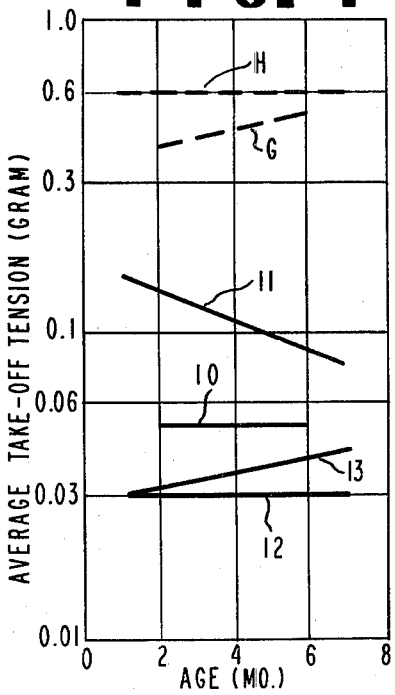
Figure 5:
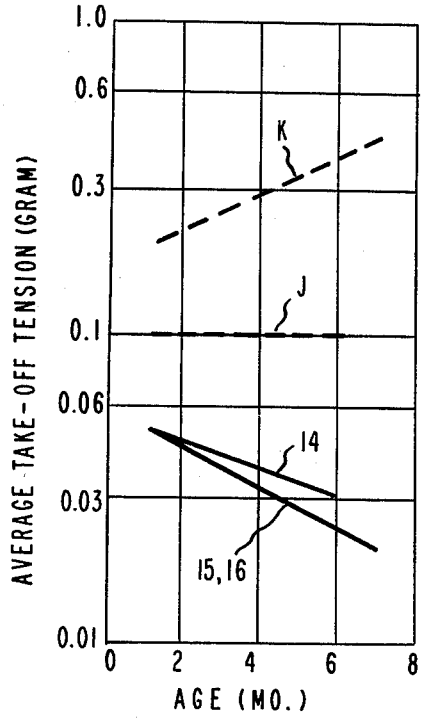

The results of the tests are summarized in Table II and are depicted in FIG. 4. These results show the extraordinary reduction in tackiness that is provided to the spandex filaments of this example by effective amounts of calcium stearate, magnesium stearate or lithium stearate. Note that control "I", which contains only 0.2% calcium stearate, did not reduce the tackiness of these filaments. Nonetheless, when used in an effective amount, calcium stearate was particularly useful in reducing the tackiness of these spandex filaments. This is seen by contrasting control "H" with its average take-off tension of more than ½ gram and its more-than-300 transients of 1 gram or greater with yarns "12" (0.7% calcium stearate) and "13" (0.5% calcium stearate) which exhibited take-off tensions of 0.03 to 0.04 grams (one fifteenth of control "H") and no tension transients at all of 0.4 grams of greater.

EXAMPLE V

This example illustrates the reduction in tackiness that is obtained when a dispersion of metal stearates is present in a polyester-based linear segmented polyurethane spandex yarn.

A hydroxy-terminated polyester of about 3400 molecular weight was formed by reaction of 17.3 parts of ethylene glycol and 14.9 parts of butanediol with 67.8 parts of adipic acid. An isocyanate-terminated polyester was then formed by reacting at 80° C., 100 parts of the hydroxy-terminated polyester with 13.0 parts of p,p'-methylenediphenyl diisocyanate. The isocyanate-terminated polyester was then dissolved in 163.2 parts of N,N-dimethylacetamide and reacted with 1.30 parts ethylenediamine and 0.19 parts of diethylamine dissolved in an additional 54.6 parts of N,N-dimethyacetamide. The resultant polymer solution was blended with (a) the polyurethane formed as described in U.S. Pat. No. 3,555,115 by the reaction of t-butyldiethanolamine and methylene-bis-(4-cyclohexylisocyanate) and (b) the condensation polymer from p-cresol and divinylbenzene, as described in U.S. Pat. No. 3,553,290, which additives respectively amounted to 1.0 and 0.5 by weight of the final fibers that were produced by spinning. The thusly prepared polymer solution was dry spun in the conventional manner through orifices to form coalesced 10-filament, 125-denier yarns to which the lubricating surface finish of the preceding examples was applied. The yarns were then wound up, stored and tested for tackiness as in the preceding Examples. Yarn of the invention "14" and control "J" were prepared in one series of runs while yarns "15" and "16" and control "K" were prepared in a second series.

The results of the tests are summarized in Table III and depicted in FIG. 5. As can be seen from the summarized data, metal stearate in accordance with the invention reduced the tackiness of the yarns to desirably low levels such that no rewinding was necessary prior to use of the yarns in fabric-making operations. However, note that the reduction in tackiness was not as dramatic as in Examples I through IV. Evidently, the polyester-based spandex used in this Example was inherently less tacky than the polyether-based spandexes used in the preceding examples. Nonetheless, the metal soaps used in accordance with the present invention provided very large improvements in the tackiness of this polyester-based spandex.

EXAMPLE VI

Spandex yarns were prepared as in Example IV with the exception that several different metallic soaps were dispersed within the filaments and all yarns were 10-filament yarns. The soaps were made from the calcium, lithium or magnesium salts of fatty acids having between 8 and 22 carbon atoms. The identification of the soaps, their concentration, and the results of tackiness measurements on filaments containing these soaps are given in Table IV. Samples "10", "11" and "12" are included in the table from Example IV. Note that controls "L" and "M" were not of the invention. Control "M" contained calcium octoate which has only eight carbon atoms. This soap increased the tackiness of the spandex yarn. In contrast, samples which contained other soaps in accordance with the invention exhibited much less tackiness.

TABLE I

TACKINESS OF SPANDEX YARNS OF EXAMPLES I AND II
(Samples designated with numerals are of the invention; others are controls)

| Sample | Stearate Additive Metal | Stearate Additive % | Age Months | Take-Off Tension, gram Average | Transients ≧0.4 | Transients ≧1.0 |
|---|---|---|---|---|---|---|
| Example I | | | | | | |
| A | 0 | 0 | 1 | 0.20 | 102 | 1 |
| | | | 5 | 0.40 | 948 | 123 |
| B | 0 | 0 | 1 | 0.15 | 127 | 4 |
| | | | 7 | 0.75 | 952 | 293 |
| 1 | Mg | 0.5 | 1 | 0.02 | 0 | 0 |
| | | | 5 | 0.08 | 1 | 0 |
| 2 | Ca | 0.7 | 1 | 0.10 | 13 | 0 |
| | | | 7 | 0.25 | 414 | 2 |
| 3 | Li | 0.5 | 1 | 0.02 | 2 | 0 |
| | | | 7 | 0.07 | 6 | 0 |
| Example II | | | | | | |
| C | 0 | 0 | 1 | 0.15 | 82 | 0 |
| | | | 6 | 0.50 | 1065 | 183 |
| D | 0 | 0 | 1 | 0.15 | 72 | 1 |
| | | | 5 | 0.80 | 1081 | 566 |
| 4 | Mg | 0.7 | 1 | 0.04 | 0 | 0 |
| | | | 6 | 0.04 | 0 | 0 |
| 5 | Ca | 0.8 | 1 | 0.10 | 5 | 0 |
| | | | 5 | 0.40 | 863 | 521 |
| 6 | Li | 0.6 | 1 | 0.03 | 17 | 0 |
| | | | 5 | 0.05 | 0 | 0 |

TABLE II

TACKINESS OF SPANDEX YARNS OF EXAMPLES III AND IV
(Samples designated with numerals are of the invention; others are controls)

| Sample | Stearate Additive Metal | % | Age Months | Take-Off Tension, gram Average | Transients ≧0.4 | Transients ≧1.0 |
|---|---|---|---|---|---|---|
| Example III | | | | | | |
| E | 0 | 0 | 1 | 0.50 | 1191 | 217 |
| | | | 5 | 0.70 | 1278 | 474 |
| F | 0 | 0 | 1 | 0.60 | 1704 | 585 |
| | | | 6 | 1.0 | 1516 | 924 |
| 7 | Mg | 0.5 | 1 | 0.05 | 0 | 0 |
| | | | 5 | 0.03 | 0 | 0 |
| 8 | Ca | 0.6 | 1 | 0.01 | 0 | 0 |
| | | | 6 | 0.04 | 0 | 0 |
| 9 | Li | 0.6 | 1 | 0.08 | 4 | 0 |
| | | | 6 | 0.07 | 5 | 0 |
| Example IV | | | | | | |
| G | 0 | 0 | 2 | 0.40 | 925 | 76 |
| | | | 6 | 0.50 | 1122 | 97 |
| H | 0 | 0 | 1 | 0.60 | 1281 | 301 |
| | | | 7 | 0.60 | 1318 | 368 |
| 10 | Mg | 0.6 | 2 | 0.05 | 0 | 0 |
| | | | 6 | 0.05 | 0 | 0 |
| 11 | Li | 0.5 | 1 | 0.15 | 80 | 3 |
| | | | 7 | 0.08 | 0 | 0 |
| 12 | Ca | 0.7 | 1 | 0.03 | 0 | 0 |
| | | | 7 | 0.03 | 0 | 0 |
| 13 | Ca | 0.5 | 1 | 0.03 | 0 | 0 |
| | | | 7 | 0.04 | 0 | 0 |
| I | Ca | 0.2 | 2 | 0.35 | 996 | 101 |
| | | | 6 | 0.30 | 792 | 46 |

TABLE III

TACKINESS OF SPANDEX YARNS OF EXAMPLES V
(Samples designated with numerals are of the invention; others are controls)

| Sample | Stearate Additive Metal | % | Age Months | Take-Off Tension, gram Average | Transients ≧0.4 | Transients ≧1.0 |
|---|---|---|---|---|---|---|
| J | 0 | 0 | 1 | 0.10 | 9 | 0 |
| | | | 6 | 0.10 | 4 | 0 |
| K | 0 | 0 | 1 | 0.20 | 469 | 27 |
| | | | 7 | 0.40 | 1187 | 116 |
| 14 | Mg | 0.7 | 1 | 0.05 | 2 | 0 |
| | | | 6 | 0.03 | 0 | 0 |
| 15 | Li | 0.6 | 1 | 0.05 | 0 | 0 |
| | | | 7 | 0.02 | 0 | 0 |
| 16 | Ca | 0.6 | 1 | 0.05 | 0 | 0 |

TABLE III-continued

TACKINESS OF SPANDEX YARNS OF EXAMPLES V
(Samples designated with numerals are of the invention; others are controls)

| Sample | Stearate Additive Metal | % | Age Months | Take-Off Tension, gram Average | Transients ≧0.4 | Transients ≧1.0 |
|---|---|---|---|---|---|---|
| | | | 7 | 0.02 | 0 | 0 |

TABLE IV

TACKINESS OF SPANDEX YARNS OF EXAMPLE VI**
(Samples designated with numerals are of the invention; others are controls)

| Sample | Soap* | % | Age Months | Take-Off Tension, gram Average | Transients 0.4 | Transients 1.0 |
|---|---|---|---|---|---|---|
| L | None | 0 | 2 | 0.5 | 1268 | 333 |
| | | | 6 | 1.5 | 1637 | 1041 |
| M | Ca octoate (8) | 0.2 | 2 | 1.1 | 519 | 512 |
| | | | 6 | 2.5 | 189 | 189 |
| 17 | Ca laurate (12) | 0.5 | 2 | 0.15 | 237 | 0 |
| | | | 6 | 0.10 | 2 | 0 |
| 12 | Ca stearate (18) | 0.7 | 1 | 0.03 | 0 | 0 |
| | | | 7 | 0.03 | 0 | 0 |
| 10 | Mg stearate (18) | 0.6 | 2 | 0.05 | 0 | 0 |
| | | | 6 | 0.05 | 0 | 0 |
| 11 | Li stearate (18) | 0.5 | 1 | 0.15 | 80 | 3 |
| | | | 7 | 0.08 | 0 | 0 |
| 18 | Ca behenate (22) | 0.8 | 2 | 0.10 | 29 | 0 |
| | | | 6 | 0.10 | 1 | 0 |
| 19 | Mg Behenate (22) | 0.4 | 2 | 0.05 | 0 | 0 |
| | | | 6 | 0.03 | 0 | 0 |

*Numbers in parentheses are the number of carbon atoms in the soap
**Samples 10,11 and 12 are included from Example IV.

We claim:

1. An improved spandex filament of the type having a lubricating finish on its surface, the improvement comprising a soap dispersed within the filament in an amount equal to at least 0.3% by weight of the filament and being a metal salt of a fatty acid, the metal being selected from the group consisting of calcium, lithium and magnesium and the fatty acid being selected from the group consisting of saturated and unsaturated fatty acids having 10 to 22 carbon atoms.

2. The filament of claim 1 wherein the concentration of the soap dispersed in the filament is no more than 5%.

3. The filament of claim 1 wherein the concentration of the soap dispersed within the filament is in the range of 0.5 to 1.0%.

4. The filament of claim 1, 2 or 3 wherein the fatty acid is a saturated fatty acid.

5. The filament of claim 1, 2 or 3 wherein the soap is a metal stearate.

6. The filament of claim 1, 2 or 3 wherein the soap is calcium stearate.

* * * * *